US009206813B2

(12) United States Patent
Lin et al.

(10) Patent No.: US 9,206,813 B2
(45) Date of Patent: Dec. 8, 2015

(54) CENTRIFUGAL FAN

(75) Inventors: Hsin-Chen Lin, Taoyuan Hsien (TW); Hsiang-Jung Huang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 598 days.

(21) Appl. No.: 13/495,715

(22) Filed: Jun. 13, 2012

(65) Prior Publication Data

US 2013/0115066 A1 May 9, 2013

(30) Foreign Application Priority Data

Nov. 9, 2011 (TW) ..... 100140875 A

(51) Int. Cl.
*F04D 29/16* (2006.01)
*F04D 25/08* (2006.01)

(52) U.S. Cl.
CPC ..... *F04D 29/162* (2013.01); *F04D 25/08* (2013.01)

(58) Field of Classification Search
CPC ..... F04D 25/08; F04D 25/162; F04D 29/162
USPC ..... 415/203, 204, 206
See application file for complete search history.

(56) References Cited

U.S. PATENT DOCUMENTS 5,281,106 A * 1/1994 Reinhardt et al. ..... 417/354
5,813,831 A * 9/1998 Matsunaga et al. ..... 415/173.6
6,884,033 B2 * 4/2005 Liao ..... 415/206
7,329,095 B2 * 2/2008 Wang ..... 415/206
8,562,291 B2 * 10/2013 Tan ..... 415/178
9,011,092 B2 * 4/2015 Eguchi et al. ..... 415/211.2
2004/0219013 A1 * 11/2004 Hopfensperger ..... 415/206
2008/0019827 A1 * 1/2008 Hirata ..... 415/206
2008/0107523 A1 * 5/2008 Chen et al. ..... 415/206
2009/0053053 A1 * 2/2009 Lin ..... 415/206
2009/0142179 A1 6/2009 Hwang et al.
2009/0180868 A1 * 7/2009 Nakamura et al. ..... 415/204

FOREIGN PATENT DOCUMENTS

TW 200923216 A 6/2009
TW 200928109 A 7/2009

* cited by examiner

*Primary Examiner* — Richard Edgar
*Assistant Examiner* — Juan G Flores
(74) *Attorney, Agent, or Firm* — Muncy, Geissler, Olds & Lowe, P.C.

(57) ABSTRACT

A centrifugal fan comprises an impeller and a casing. The impeller includes a hub and a plurality of blades. The casing comprises an upper casing, a lower casing, at least one protrusion, a first inlet opening and a second inlet opening. The lower casing is disposed opposite to the upper casing and connected to the upper casing to form an accommodation room for receiving the impeller. The protrusion is formed on the upper casing and/or the lower casing inside the casing and immediately surrounds the blades. The first inlet opening is defined on the upper casing and comprises a primary inlet opening augmented by a secondary inlet opening. The second inlet opening is defined on the lower casing. The protrusion surrounds the first inlet opening and/or second inlet opening.

13 Claims, 7 Drawing Sheets

CENTRIFUGAL FAN

CROSS REFERENCE TO RELATED APPLICATIONS

This Non-provisional application claims priority under 35 U.S.C. §119(a) on Patent Application No(s). 100140875 filed in Taiwan, Republic of China on Nov. 9, 2011, the entire contents of which are hereby incorporated by reference.

BACKGROUND OF THE INVENTION

1. Field of Invention

The present invention relates to a fan and, in particular, to a centrifugal fan.

2. Related Art

Since the electronic industries have been in progressive in the recent years, the electronic products may include many heat-generating electronic components, such as chips, that generate more and more heat. In order to effectively dissipate the redundant heat, it is usually to dispose a heat sink on the surface of the electronic component and then to install a centrifugal fan on the heat sink. The centrifugal fan can generate cooling airflow to remove the heat from the heat sink, thereby dissipating the heat of the electronic components.

FIG. 1A is a top view of a conventional centrifugal fan 1, and FIG. 1B is a sectional view of the centrifugal fan 1 of FIG. 1A. As shown in FIGS. 1A and 1B, the centrifugal fan 1 includes an impeller 11 and a casing 12. The impeller 11 is disposed in the casing 12. The impeller 11 has a hub 111 connecting with the casing 12 and a blade 112 disposed surrounding the hub 111. The casing 12 includes a upper casing 121 and a lower casing 122, which are connected to each other. The impeller 11 is disposed between the upper casing 121 and the lower casing 122.

The surfaces of the upper casing 121 and the lower casing 122 are planar surfaces, and a gap exists between the blade 112, the upper casing 121 and the lower casing 122. Accordingly, when the pressure inside the fan increases to be larger than the external pressure, the air can flow through the gap and then exit the fan through the inlet openings of the upper casing 121 and lower casing 122 (see arrows). Thus, the air input quantity as well as the air output quantity may decrease, thereby affecting the entire heat-dissipation performance.

Therefore, it is an important subject to provide a centrifugal fan that can prevent the air reflow, which decreases the air input quantity, and effectively drive the air flowing toward the outlet opening so as to increase the air output quantity, thereby enhancing the heat-dissipation performance.

SUMMARY OF THE INVENTION

In view of the foregoing subject, an object of the present invention is to provide a centrifugal fan that can prevent the air reflow and the pressure leakage, and can adjust the dimension of the inlet opening so as to increase the air input quantity, thereby enhancing the heat-dissipation performance.

To achieve the above object, the present invention discloses a centrifugal fan comprising an impeller and a casing. The impeller includes a hub and a plurality of blades. The casing comprises an upper casing, a lower casing, at least one protrusion, a first inlet opening and a second inlet opening. The lower casing is disposed opposite to the upper casing and connected to the upper casing to form an accommodation room for receiving the impeller. The protrusion is formed on the upper casing and/or the lower casing inside the casing and immediately surrounds the blades. The first inlet opening is defined on the upper casing and comprises a primary inlet opening augmented by a secondary inlet opening. The second inlet opening is defined on the lower casing. The protrusion surrounds the first inlet opening and/or second inlet opening.

In one embodiment of the present invention, the casing further includes an outlet opening disposed between the upper casing and the lower casing, and the secondary inlet opening is near the outlet opening.

In one embodiment of the present invention, a shape of the protrusion viewed in a rotational axis direction is annular or arc.

In one embodiment of the present invention, the lower casing includes a throat portion.

In one embodiment of the present invention, the protrusion is close to the outlet opening.

In one embodiment of the present invention, the protrusion is away from the outlet opening.

In one embodiment of the present invention, when the casing includes a plurality of protrusions, the protrusions are disposed on the upper casing and/or the lower casing.

In one embodiment of the present invention, the second inlet opening is defined on the second casing and opposite to the first inlet opening.

In one embodiment of the present invention, the blades are disposed surrounding the hub.

In one embodiment of the present invention, the impeller is connected with the casing through the hub.

In one embodiment of the present invention, a gap exists between the blade and the upper casing or the lower casing. A height of the protrusion is greater than a quarter of the gap width.

In one embodiment of the present invention, the protrusion is undetachably formed with the upper casing or the lower casing.

In one embodiment of the present invention, a radius of an outer end edge of the blade from a rotational axis of the impeller is larger than that of the first inlet opening.

In one embodiment of the present invention, the protrusion is arc or annular and centered over the impeller, and extends azimuthally along a radius larger than that of outer end edges of the blades.

To achieve the above object, the present invention further discloses a centrifugal fan comprising an impeller and a casing. A centrifugal fan includes an impeller and a casing. The impeller includes a hub and a plurality of blades. A casing includes an upper casing, a lower casing, an inlet opening and at least one protrusion. The lower casing is disposed opposite to the upper casing and connected to the upper casing to form an accommodation room for receiving the impeller. The first inlet opening is defined on the upper casing. At least one protrusion is formed on the upper casing inside the casing and immediately surrounds the blades.

In one embodiment of the present invention, the first inlet opening includes a primary inlet opening augmented by a secondary inlet opening. The fan further includes an outlet opening disposed between the upper casing and the lower casing, and the secondary inlet opening is near the outlet opening.

In one embodiment of the present invention, a shape of the protrusion viewed in a rotational axis direction is annular or arc. As mentioned above, the centrifugal fan of the present invention is configured with a protrusion on at least one of the upper casing and the lower casing and surrounding the blade, so that the air entering from the inlet opening can be prevented from reflowing back to outside due to the pressure inside the casing. In addition, it is possible to configure multiple protrusions with different shapes on the casing to fit different environments or apply to the centrifugal fans of different dimensions. Moreover, the inlet opening of the centrifugal fan of the present invention includes a first inlet opening and a second inlet opening, so that it is possible to adjust the air input quantity of the centrifugal fan by adjusting the sizes of the first and second inlet openings.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
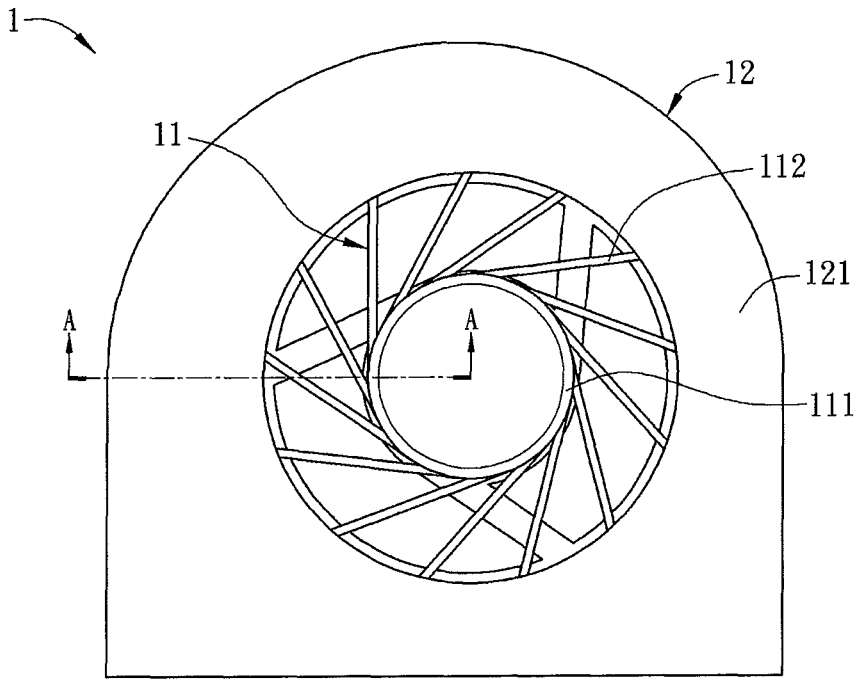
FIG. 1A(Prior Art)
FIG. 1A is a top view of the conventional centrifugal fan.
Figure 1B:
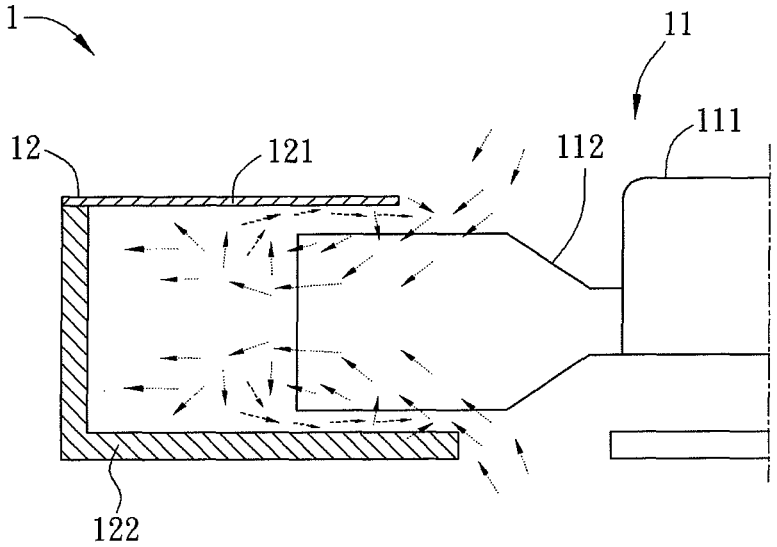
FIG. 1B(Prior Art)
FIG. 1B is a sectional view of the centrifugal fan of FIG. 1A.
Figure 2A:
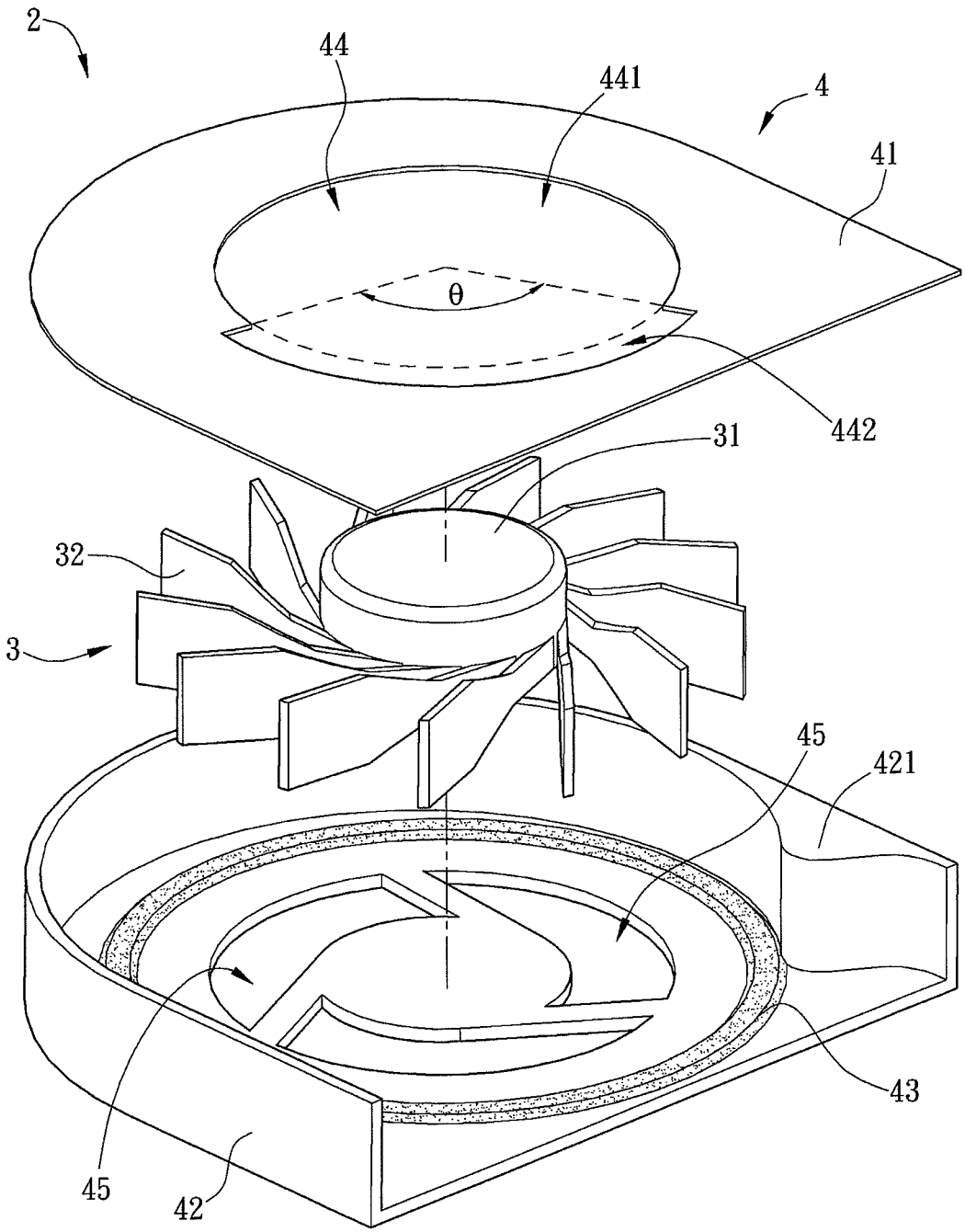
FIG. 2A is an exploded view of a centrifugal fan according to a preferred embodiment of the present invention.
Figure 2B:
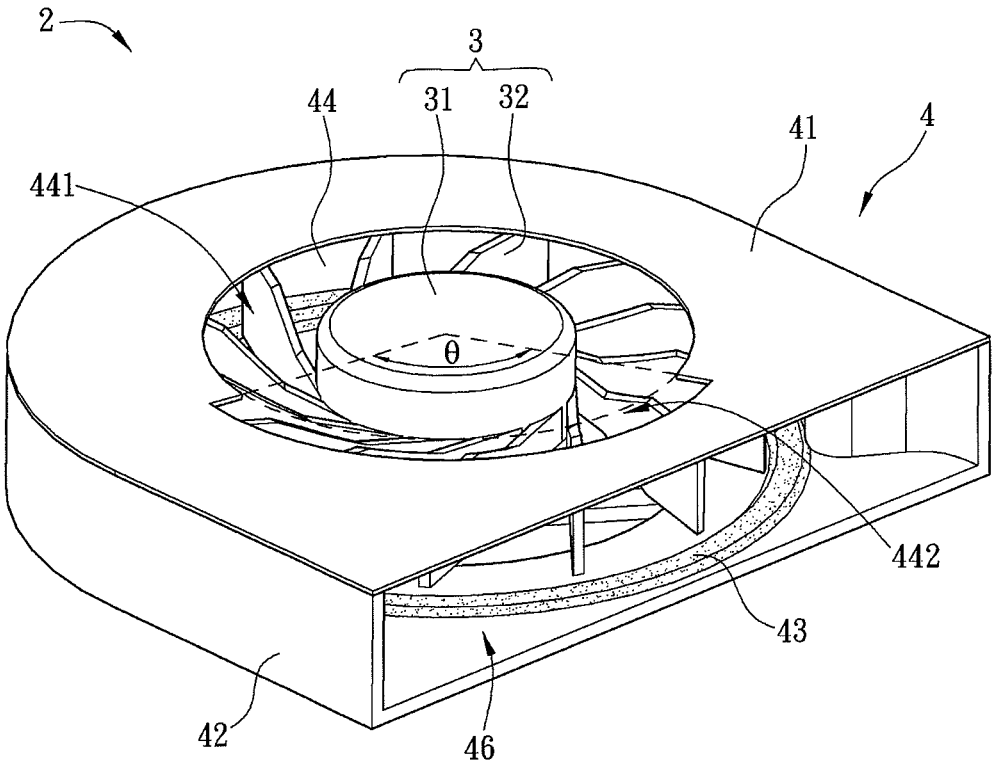
FIG. 2B is a perspective view of the assembled centrifugal fan of FIG. 2A.

FIG. 2A is an exploded view of a centrifugal fan 2 according to a preferred embodiment of the present invention, and FIG. 2B is a perspective view of the assembled centrifugal fan 2 of FIG. 2A. Referring to FIGS. 2A and 2B, the centrifugal fan 2 includes an impeller 3 and a casing 4.

The impeller 3 includes a hub 31 and blades 32. The blades 32 are disposed surrounding the hub 31.

The casing includes an accommodation room for receiving the impeller 3. In the embodiment, the casing 4 includes an upper casing 41, a lower casing 42, at least one protrusion 43, and a first inlet opening 44. The upper casing 41 and the lower casing 42 are disposed opposite and connected to each other to form the accommodation room for receiving the impeller 3. The impeller 3 is disposed inside the accommodation room of the casing 4 and connected with the casing 4 by the hub 31. In this case, the hub 31 of the impeller 3 is connected with the lower casing 42 of the casing 4.

Figure 2C:
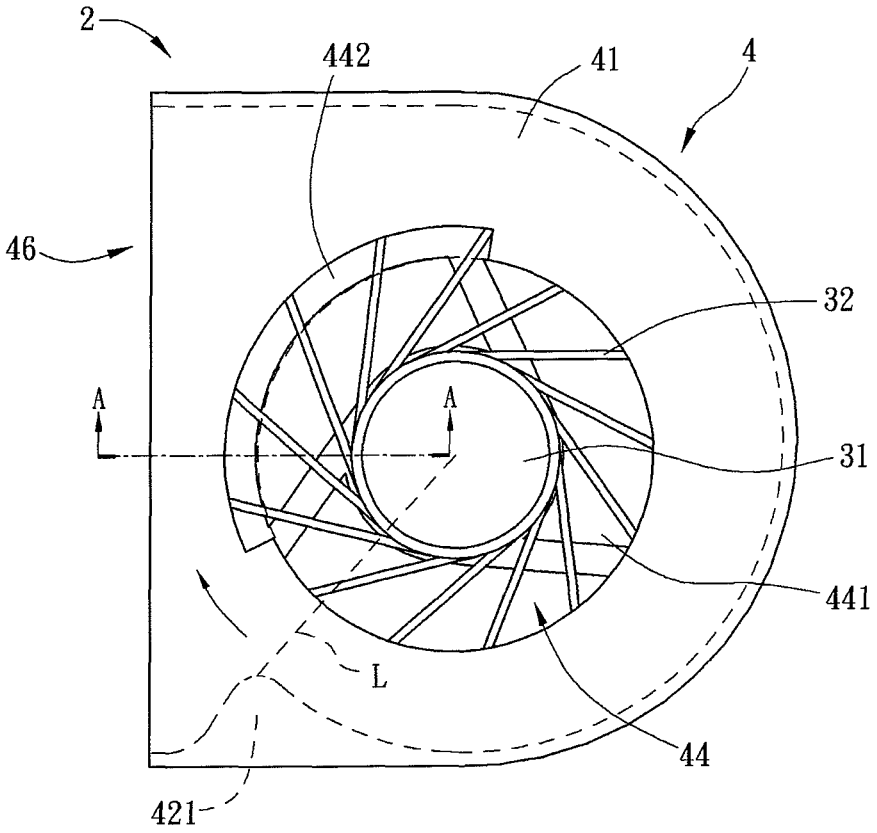
FIG. 2C is a top view of the centrifugal fan of FIG. 2B.
Figure 2D:
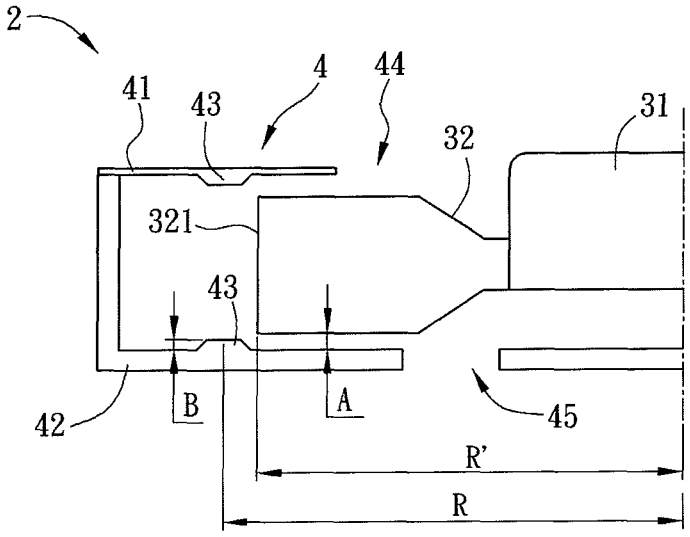
FIG. 2D is a sectional view of the centrifugal fan of FIG. 2C.

FIG. 2C is a top view of the centrifugal fan 2 of FIG. 2B, and FIG. 2D is a sectional view of the centrifugal fan 2 of FIG. 2C. With reference to FIG. 2D, the protrusions 43 are disposed on the upper casing 41 and the lower casing 42, and immediately surround the blades 32. That is, the protrusions are 43 arc or annular and centered over the impeller 3, and extend azimuthally along the radius R a little larger than the radius R' of outer end edges 321 of the blades 32. Furthermore, the radius R' of the outer end edges 321 of the blades 32 from the rotational axis of the impeller 3 is larger than that of the outer end edges of the first inlet opening 44 and the second inlet opening 45. Therefore, the impeller 3 can be always received with the casing. In this case, the protrusions 43 and the upper casing 41 or the lower casing 42 can be undetachably formed or separated components. This configuration is for illustration only and is not to limit the scope of the present invention. In this embodiment, when the casing 4 includes a plurality of protrusions 43, the protrusions 43 can be separately disposed on the upper casing 41 and the lower casing 42. Otherwise, the protrusions 43 can be all disposed on either the upper casing 41 or the lower casing 42. In addition, the shape of the protrusions 43 viewed in the rotational axis 43 can be annular, arc, linear, or other aspects. In the centrifugal fan 2 of this embodiment, for example, the casing 4 includes two annular protrusions 43, which are separately disposed on the upper casing 41 and the lower casing 42.

Figure 3A:
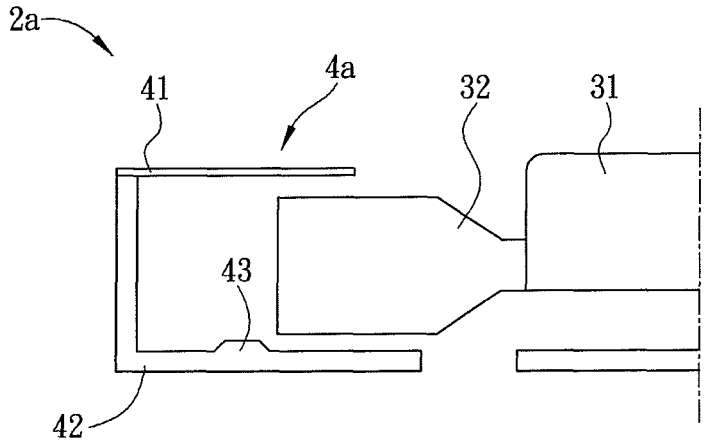
FIGS. 3A and 3B are schematic diagrams showing different aspects of the casing of the present invention.
Figure 3B:
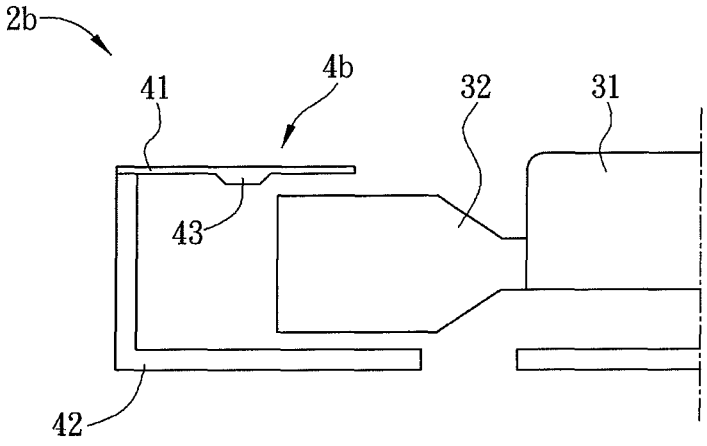

FIGS. 3A and 3B are schematic diagrams showing different aspects of the casing of the present invention. In this aspect, the casing 4*a* of the centrifugal fan 2*a* has an annular protrusion 43 disposed on the lower casing 42. In another aspect, the casing 4*b* of the centrifugal fan 2*b* has an annular protrusion 43 disposed on the upper casing 41.

Referring to FIG. 2D again, it is noted that a gap A exists between the blades 32 and the upper casing 41 or the lower casing 42. Besides, the protrusion 43 has a height B, which is greater than a quarter of the gap width A. For example, if the gap A is 0.4 cm, the height B of the protrusion 43 is larger than 0.1 cm. This configuration can prevent the air from reflowing back to outside through the inlet opening 44 due to the pressure inside the casing 4.

Referring to FIGS. 2A to 2C again, the inlet opening 44 is disposed on the upper casing 41. In this embodiment, the first inlet opening 44 includes a primary inlet opening 441 and a secondary inlet opening 442. The first inlet opening 44 is defined on the upper casing 41 and comprises a primary inlet opening 441 augmented by a secondary inlet opening 442. The first primary opening 441 can be any shape. In this embodiment, the first primary inlet opening 441 is circular. The secondary inlet opening 442 can be, for example, a semicircular opening or an arc opening. In this embodiment, the secondary inlet opening 442 is an arc opening. In more specific, the primary inlet opening 441 can be seemed as a circle, and the hub 31 of the centrifugal fan 2 can be seemed as a center of the circle.

In addition, the casing 4 further includes a second inlet opening 45 defined on the lower casing 42 and opposite to the first inlet opening 44. In this embodiment, the shape and size of the second inlet opening 45 may different from that of the first inlet opening 44.

The casing may further include an outlet opening 46 disposed between the upper casing 41 and the lower casing 42. The outlet opening 46 is disposed vertically with respect to the first inlet opening 44 and the second inlet opening 45 for outputting the air inside the centrifugal fan 2.

The lower casing 42 includes a throat portion 421. In more specific, the throat portion 421 is disposed on one side of the lower casing 42 close to the outlet opening 46 as well as the blades 32, so that the air inside the casing 4 can flow in counterclockwise as shown in FIG. 2A and then be outputted through the outlet opening 46.

In this case, the angle θ of the secondary inlet opening 442 is greater than 90°. As shown in FIG. 2C, assuming the rotational axis of the hub 31 is a center and a base line L is from the center of the hub 31 to the throat portion 421, the range of the secondary inlet opening 442 is smaller than 270° starts from the base line L in the clockwise direction.

Figure 4A:
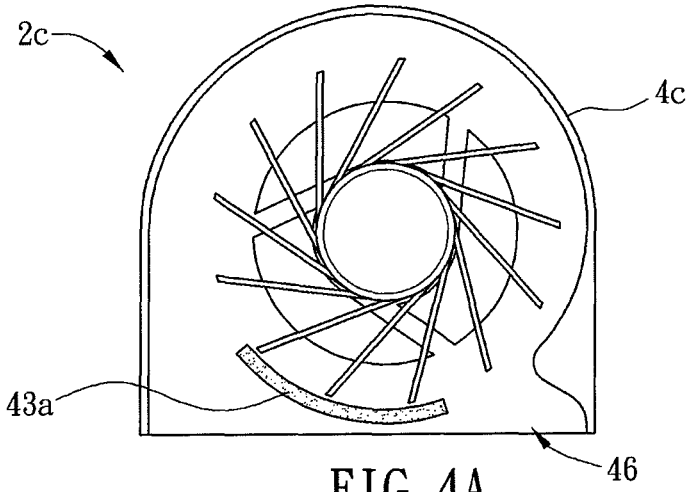
FIGS. 4A to 4C are schematic diagrams showing different aspects of the casing of the present invention.
Figure 4B:
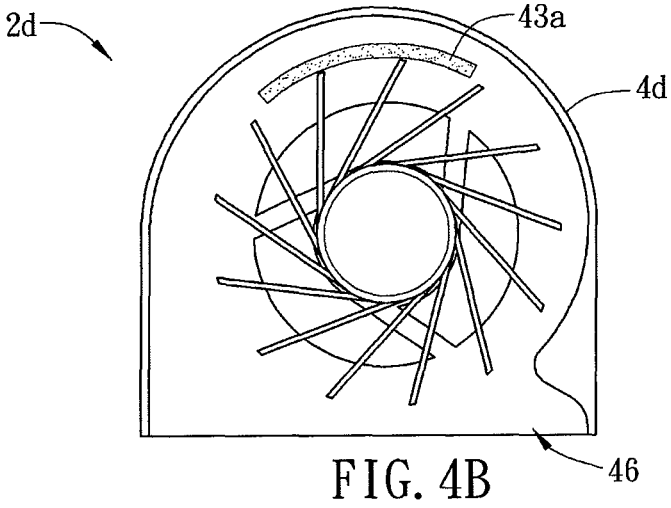
Figure 4C:
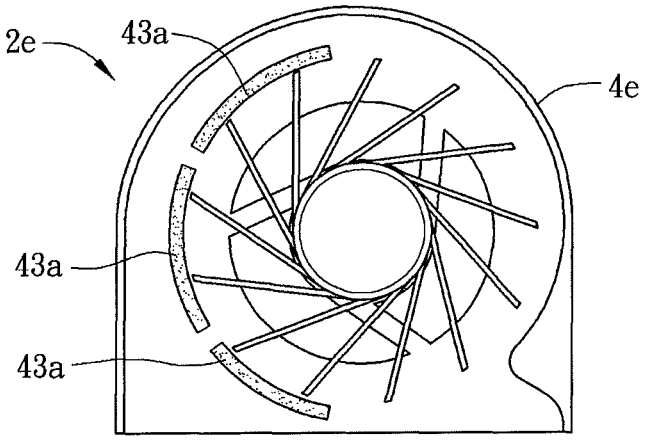

FIGS. 4A to 4C are schematic diagrams showing different aspects of the casing of the present invention. As mentioned above, the shape of the protrusion can be annular, arc, linear, or other aspects, and the protrusion can be disposed immediately surrounds the blades 32. That is, when the protrusion 43 is arc or annular and centered over the impeller 3, the protrusion 43 extends azimuthally along a radius R larger than the radius R' of an outer end edge 321 of the blades 32. As shown in FIG. 4A, the shape of the protrusion 43*a* of the centrifugal fan 2*c* is arc, and the protrusion 43*a* is disposed inside the casing 4*c* close to the outlet opening 46. In this case, the protrusions 43*a* can be disposed on both of the upper casing 41 and the lower casing 42; otherwise, it can be disposed on either the upper casing 41 or the lower casing 42. As shown in FIG. 4B, the protrusion 43*a* of the centrifugal fan 2*d* is disposed away from the outlet opening 46. As shown in FIG. 4C, a plurality of protrusions 43*a* are configured on the casing 4*e* of the centrifugal fan 2*e*. In this case, the protrusions 43*a* can be all disposed on the upper casing 41 or the lower casing 42; otherwise, they can be separately disposed on the upper casing 41 and the lower casing 42.

Figure 5:
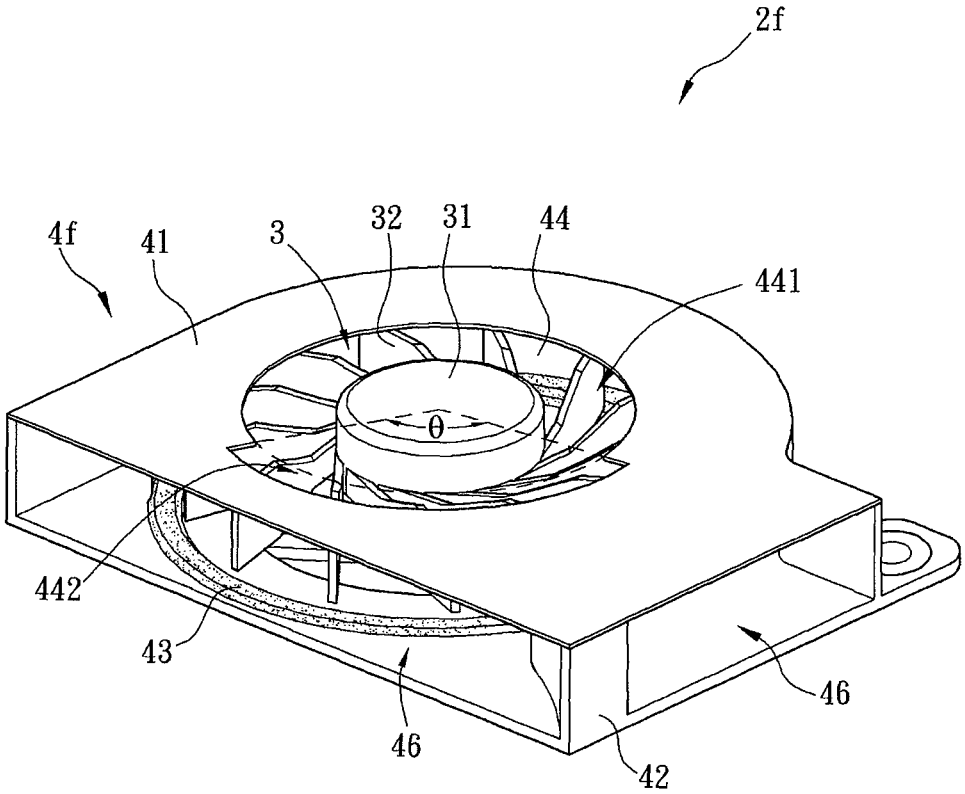
FIG. 5 is a schematic diagram showing another aspect of the centrifugal fan of the present invention.

FIG. 5 is a schematic diagram showing another aspect of the centrifugal fan of the present invention. Referring to FIG. 5, the casing 4*f* of the centrifugal fan 2*f* has two outlet openings 46, which are disposed at two sides of the casing 4*f*, respectively. In this embodiment, the casing 4*f* includes protrusions 43 configured on the upper casing 41 and the lower casing 42. Accordingly, the centrifugal fan 2*f* of the present embodiment can not only prevent the air reflow so as to increase the air input quantity, but also output airflows toward two different directions so as to enhance the heat-dissipation performance. To be noted, the angle θ of the secondary inlet opening 442 in this embodiment is also smaller than 270°.

In summary, the centrifugal fan of the present invention is configured with a protrusion on at least one of the upper casing and the lower casing and surrounding the blade, so that the air entering from the inlet opening can be prevented from reflowing back to outside due to the pressure inside the casing. In addition, it is possible to configure multiple protrusions with different shapes on the casing to fit different environments or apply to the centrifugal fans of different dimensions. Moreover, the inlet opening of the centrifugal fan of the present invention includes a first inlet opening and a second inlet opening, so that it is possible to adjust the air input quantity of the centrifugal fan by adjusting the sizes of the first and second inlet openings.

Compared with the prior art, the centrifugal fan of the present invention can effectively guide the airflow to decrease the air reflow and thus the pressure leakage, and can adjust the size of the inlet opening to increase the air input quantity. Besides, it is possible to modify or change the shape or position of the protrusion according different environments or the pressure inside the casing so as to increase the air input quantity, thereby obtaining the best heat-dissipation performance.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A centrifugal fan, comprising:

an impeller having a hub and a plurality of blades; and a casing comprising:

an upper casing;

a lower casing disposed opposite to the upper casing and connected to the upper casing to form an accommodation room for receiving the impeller;

a plurality of protrusions all disposed on the upper casing or the lower casing inside the casing and immediately surrounding the blades; and a first inlet opening defined on the upper casing and comprising a primary inlet opening augmented by a secondary inlet opening;

a second inlet opening defined on the lower casing;

wherein the primary inlet opening is circular and centered on a rotation axis of the impeller and the protrusion surrounds the first inlet opening or the second inlet opening, wherein a gap exists between the blades and the upper casing or the lower casing, wherein a height of the protrusion is greater than a quarter of a height of the gap, and the height of the protrusion is less than the height of the gap.

2. The fan of claim 1, wherein the casing further comprises an outlet opening disposed between the upper casing and the lower casing, and the secondary inlet opening is near the outlet opening.

3. The fan of claim 2, wherein the protrusion is close to the outlet opening.

4. The fan of claim 2, wherein the protrusion is away from the outlet opening.

5. The fan of claim 1, wherein a shape of the protrusion viewed in a rotational axis direction is annular or arc.

6. The fan of claim 1, wherein the lower casing comprises a throat portion.

7. The fan of claim 1, wherein the second inlet opening is defined on the second casing and opposite to the first inlet opening.

8. The fan of claim 1, wherein the blades are disposed surrounding the hub.

9. The fan of claim 1, wherein the impeller is disposed inside the accommodation room of the impeller and connected with the casing through the hub.

10. The fan of claim 1, wherein the protrusion is undetachably formed with the upper casing or the lower casing.

11. The fan of claim 1, wherein a radius of outer end edges of the blades from a rotational axis of the impeller is larger than that of the outer end edge of the first inlet opening.

12. The fan of claim 1, wherein the protrusion is arc or annular and centered over the impeller, and extends azimuthally along a radius larger than that of outer end edges of the blades.

13. The fan of claim 1, wherein the casing further comprises two outlet openings disposed at two sides of the casing, respectively.

* * * * *